US009641942B2

(12) United States Patent
Strelcyk et al.

(10) Patent No.: US 9,641,942 B2
(45) **Date of Patent: *May 2, 2017**

(54) METHOD AND APPARATUS FOR HEARING ASSISTANCE IN MULTIPLE-TALKER SETTINGS

(71) Applicant: Starkey Laboratories, Inc., Eden Prairie, MN (US)

(72) Inventors: Olaf Strelcyk, Loveland, OH (US); Sridhar Kalluri, El Cerrito, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/841,315

(22) Filed: Aug. 31, 2015

(65) Prior Publication Data

US 2015/0373465 A1 Dec. 24, 2015

Related U.S. Application Data

(63) Continuation of application No. 13/939,004, filed on Jul. 10, 2013, now Pat. No. 9,124,990.

(51) Int. Cl.
*H04R 25/00* (2006.01)

(52) U.S. Cl.
CPC ..... *H04R 25/40* (2013.01); *H04R 25/405* (2013.01); *H04R 25/50* (2013.01); *H04R 2225/023* (2013.01); *H04R 2225/025* (2013.01); *H04R 2225/43* (2013.01); *H04S 2420/01* (2013.01)

(58) Field of Classification Search
CPC ..... H04R 25/00; H04R 25/43; H04R 25/407; H04R 25/505; H04R 2225/41; H04R 2225/43; H04R 3/005
See application file for complete search history.

(56) References Cited

U.S. PATENT DOCUMENTS

| | | | |
|---|---|---|---|
| 6,154,552 | A | 11/2000 | Koroljow et al. |
| 6,243,476 | B1 | 6/2001 | Gardner |
| 6,961,439 | B2 | 11/2005 | Ballas |
| 7,853,030 | B2 | 12/2010 | Grasbon et al. |
| 8,170,247 | B2 | 5/2012 | Nishizaki |

(Continued)

OTHER PUBLICATIONS

"U.S. Appl. No. 13/939,004, Advisory Action mailed Mar. 27, 2015", 2 pgs.

(Continued)

*Primary Examiner* — Matthew Eason
(74) *Attorney, Agent, or Firm* — Schwegman, Lundberg & Woessner, P.A.

(57) ABSTRACT

Disclosed herein, among other things, are systems and methods for hearing assistance in multiple-talker settings. One aspect of the present subject matter includes a method of operating a hearing assistance device for a user in an environment. A parameter is sensed relating to facing orientation of a talker in communication within the environment. Parameters related to location and talking activity of a talker can also be used. In various embodiments, facing orientation, location, and talking activity of the talker are estimated based on the sensed parameter. A hearing assistance device parameter is adjusted based on the estimated facing orientation, location, and talking activity of the talker, according to various embodiments.

21 Claims, 6 Drawing Sheets

(56) References Cited

U.S. PATENT DOCUMENTS

| | | | | |
|---|---|---|---|---|
| 9,124,990 | B2 | 9/2015 | Strelcyk et al. | |
| 2003/0099370 | A1* | 5/2003 | Moore | G02C 11/06 381/312 |
| 2005/0141731 | A1 | 6/2005 | Hamalainen | |
| 2010/0074460 | A1 | 3/2010 | Marzetta | |
| 2011/0091056 | A1 | 4/2011 | Nishizaki et al. | |
| 2012/0020503 | A1 | 1/2012 | Endo et al. | |
| 2012/0128186 | A1* | 5/2012 | Endo | H04R 25/407 381/313 |
| 2013/0329923 | A1* | 12/2013 | Bouse | H04R 25/40 381/313 |
| 2015/0016644 | A1 | 1/2015 | Strelcyk et al. | |

OTHER PUBLICATIONS

"U.S. Appl. No. 13/939,004, Final Office Action mailed Jan. 13, 2015", 12 pgs.
"U.S. Appl. No. 13/939,004, Non Final Office Action mailed Aug. 13, 2014", 11 pgs.
"U.S. Appl. No. 13/939,004, Notice of Allowance mailed Apr. 28, 2015", 6 pgs.
"U.S. Appl. No. 13/939,004, Response filed Mar. 12, 2015 to Final Office Action mailed Jan. 13, 2015", 8 pgs.
"U.S. Appl. No. 13/939,004, Response filed Nov. 13, 2014 to Non Final Office Action mailed Aug. 13, 2014", 8 pgs.
Boldt, Jesper Bunsow, "Estimation of the Ideal Binary Mask Using Directional Systems", Proceedings of the 11th International Workshop on Acoustic Echo and Noise Control, Seattle, WA, (2008), 4 pgs.
Nakano, Alberto Yoshihiro, et al., "Auditory perception versus automatic estimation of location and orientation of an acoustic source in a real environment", Acoust. Sci. & Tech. 31(5), (2010), 309-319.

* cited by examiner

METHOD AND APPARATUS FOR HEARING ASSISTANCE IN MULTIPLE-TALKER SETTINGS

CROSS-REFERENCE TO RELATED APPLICATION

This application is a continuation of U.S. patent application Ser. No. 13/939,004, filed Jul. 10, 2013, now issued as U.S. Pat. No. 9,124,990 on Sep. 1, 2015, which application is incorporated herein by reference in its entirety.

TECHNICAL FIELD

This document relates generally to hearing assistance systems and more particularly to methods and apparatus for hearing assistance in multiple-talker settings.

BACKGROUND

Modern hearing assistance devices, such as hearing aids, are electronic instruments worn in or around the ear that compensate for hearing losses of hearing-impaired people by specially amplifying sound. Hearing-impaired people encounter great difficulty with speech communication in multi-talker settings, particularly when attention needs to be divided between multiple talkers.

Current hearing assistance technology employs single-microphone noise reduction algorithms in order to increase perceived sound quality. This may also reduce listening effort in complex environments. However, current noise reduction algorithms do not increase speech intelligibility in multiple-talker settings. In contrast, use of static directionality systems such as microphone arrays or directional microphones in hearing aids can increase speech intelligibility by passing signals from the direction of a target talker, typically assumed to be located in front, and attenuating signals from other directions. Recently, adaptive directional systems have also been employed that adaptively follow a target with changing direction.

Directional systems only increase speech intelligibility when the direction of a target talker, or the talker of interest to the listener, relative to the listener's head remains constant in front of the listener or can be identified unambiguously. However, in many real-world situations, this is not the case. In a dinner conversation, for example, where speech from multiple concurrent talkers can reach the ear from different directions at similar sound levels, identifying the desired target location is a difficult problem. Active user feedback via a remote control may help in static scenarios where the spatial configuration does not change. However, user feedback would not be practical in situations where targets can change dynamically, such as two or more alternating talkers in a conversation.

Accordingly, there is a need in the art for improved systems and methods for enhancing speech intelligibility and reducing listening effort in multi-talker settings.

SUMMARY

Disclosed herein, among other things, are systems and methods for hearing assistance in multiple-talker settings. One aspect of the present subject matter includes a method of operating a hearing assistance device for a user in an environment. A parameter is sensed relating to facing orientation, location, and/or talking activity of a talker in communication within the environment. In various embodiments, facing orientation, location, and talking activity of the talker is estimated based on the sensed parameter. A hearing assistance device parameter is adjusted based on the estimated facing orientation, location, and talking activity of the talker, according to various embodiments.

One aspect of the present subject matter includes a hearing assistance system including a hearing assistance device for a user in an environment. The system includes a sensor configured to sense a parameter related to facing orientation, location, and/or talking activity of a talker in communication within the environment. An estimation unit is configured to estimate facing orientation, location, and talking activity of the talker based on the sensed parameter. According to various embodiments, the system also includes a processor configured to adjust a hearing assistance device parameter based on the estimated facing orientation, location, and talking activity of the talker.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
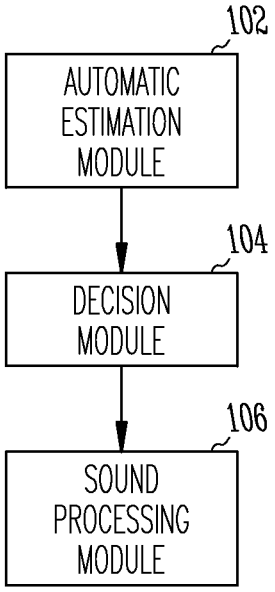
FIG. 1 is a block diagram of a system for enhancing speech intelligibility and reducing listening effort for a user of a hearing assistance device in multi-talker settings, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Hearing-impaired people encounter great difficulty with speech communication in multi-talker settings, particularly when attention needs to be divided between multiple talkers. Current hearing assistance technology employs single-microphone noise reduction algorithms in order to increase perceived sound quality. This may also reduce listening effort in complex environments. However, current noise reduction algorithms do not increase speech intelligibility in multiple-talker settings. In contrast, use of static directionality systems such as microphone arrays or directional microphones in hearing aids can increase speech intelligibility by passing signals from the direction of a target talker, typically assumed to be located in front, and attenuating signals from other directions. Recently, adaptive directional systems have also been employed that adaptively follow a target with changing direction or changing targets. Directional systems only increase speech intelligibility when the direction of a target talker, or the talker of interest to the listener, relative to the listener's head remains constant in front of the listener or can be identified unambiguously. However, in many real-world situations, this is not the case. In a dinner conversation, for example, where speech from multiple concurrent talkers can reach the ear from different directions at similar sound levels, identifying the desired target location is a difficult problem. Active user feedback via a remote control may help in static scenarios where the spatial configuration does not change. However, user feedback will not be feasible in situations where targets can change dynamically, such as two or more alternating talkers in a conversation.

The present subject matter uses knowledge of real-time talker facing orientation in an acoustic scene to aid and assist listeners in multi-talker listening. Adding knowledge of facing orientation turns hearing assistance devices into intelligent agents. The intelligence derives from the fact that talkers and receivers face each other in most scenarios of human communication. One aspect of the present subject matter includes a hearing assistance system including a hearing assistance device for a user in an environment. The system includes a sensor configured to sense a parameter related to facing orientation of a talker in communication within the environment. An estimation unit is configured to estimate facing orientation of the talker based on the sensed parameter. According to various embodiments, the system also includes a processor configured to adjust a hearing assistance device parameter based on the estimated facing orientation of the talker. In various embodiments, a sensor is configured to sense a parameter related to a location of the talker, the estimation unit is configured to estimate the location of the talker based on the sensed parameter, and the processor is configured to adjust a hearing assistance device parameter based on the estimated location of the talker. In various embodiments, a sensor is configured to sense a parameter related to talking activity of the talker, the estimation unit is configured to estimate the talking activity of the talker based on the sensed parameter, and the processor is configured to adjust a hearing assistance device parameter based on the estimated talking activity of the talker. One or more of location and talking activity of the talker can be sensed, estimated and used by the system in addition to facing orientation, in various embodiments.

FIG. 1 is a block diagram of a system for enhancing speech intelligibility and reducing listening effort for a user of a hearing assistance device in multi-talker settings, according to various embodiments of the present subject matter. The module system includes an automatic estimation unit 102 that estimates real-time talker locations, facing orientations, and/or talker speaking activity (whether a talker is speaking or not) in an acoustic scene. According to various embodiments, the estimation is based on acoustic information about the sound levels and sound spectra at the two ears, inter-aural differences in arrival time and level, and/or direct-to-reverberant energy ratios. In addition, the use of an accelerometer can inform the estimation system about head movements in order to disambiguate intrinsic changes due to listener movement from extrinsic changes, or changes in the acoustic scene, in head-related source location. In an alternate embodiment, the automatic estimation system is implemented as a separate stationary unit (including all or part of the system of FIG. 1) in the room, transmitting information about talker locations, talker orientations and talker activity wirelessly to the hearing assistance devices. The transmission is wireless, in various embodiments. In this case, the estimation would be based on arrival time, level, and spectral differences between pairs of microphones in a microphone array instead of differences between the ears. In addition, cameras and other sensors mounted in the room can also inform the estimation system, in various embodiments.

The real-time estimates of talker locations, talker facing orientations, and/or talker activity provide the input to a decision module 104. The decision module 104 analyzes the configuration of talker locations, facing orientations, and talker activity in real-time and outputs a marker signal, which indicates the single most promising target listening direction. If no such target is determined, an idle marker is returned. In various embodiments, the marker tracks the most promising listening direction and activates an acoustic pointer that is perceived in this desired target direction. The marker is configured to control adaptive directionality and/or binary masking to enhance target intelligibility, in various embodiments.

In one embodiment, the decision module performs a slow (i.e., on the order of minutes) cluster analysis on the talker locations. Then, the subsequent processing takes into account people that belong to the same cluster that the user belongs to, in various embodiments. For example, this can be a group of people sitting with the user around a table in a restaurant or a group sitting in a circle.

Figure 2A:
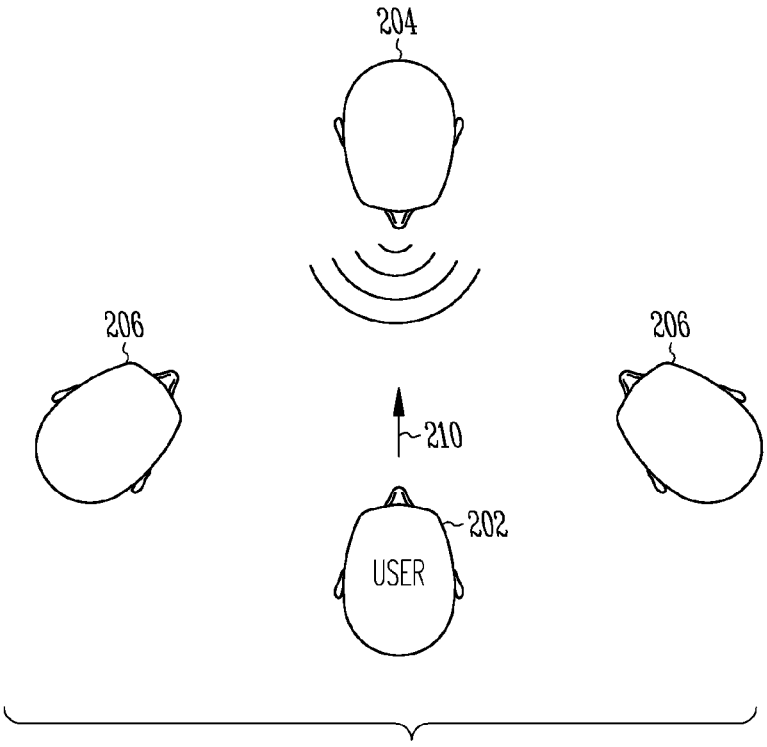
FIGS. 2A-2C illustrate a user of a hearing assistance device in a multi-talker setting, according to various embodiments of the present subject matter.
Figure 2B:
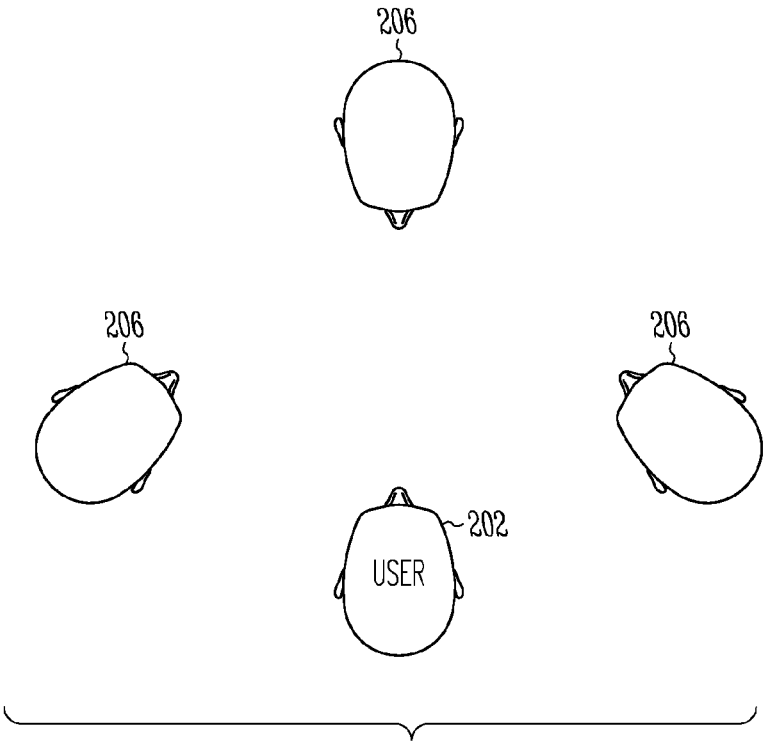
Figure 2C:
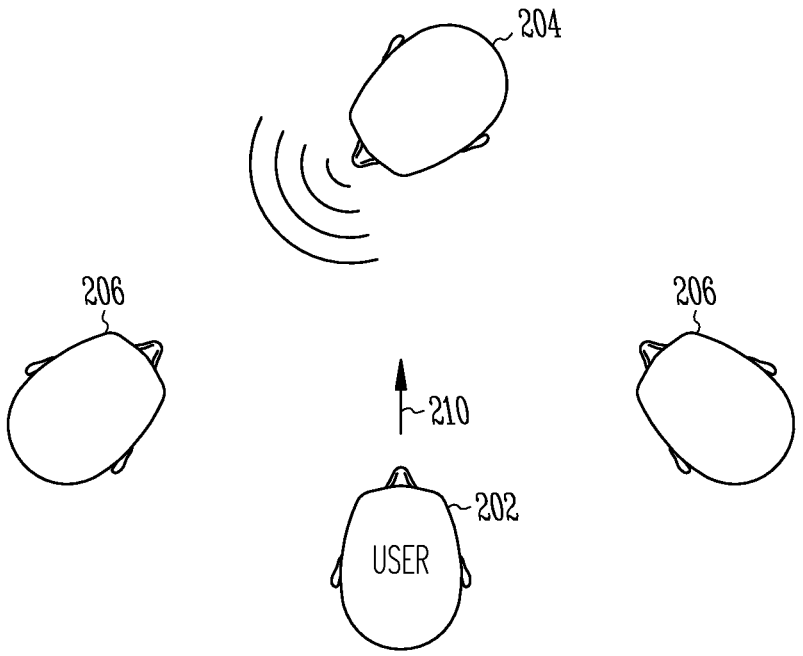

FIGS. 2A-4 illustrate a user of a hearing assistance device in a multi-talker setting, according to various embodiments of the present subject matter. As long as the user 202 (or listener or wearer) is facing another talker 204 in his or her cluster, i.e., a person who is currently talking, the marker 210 is pointed at this talker. The cluster includes non-talkers 206, in various embodiments. In FIGS. 2A and 2C, the arrow represents the direction of the marker signal 210. When the talker 204 stops speaking, the marker is set to the idle state. In FIG. 2B, the idle state is illustrated by absence of the arrow. In one embodiment, facing means that the intersection of the coronal plane (vertical plane separating the front hemisphere from the back hemisphere) of the viewed person with the line of sight of the viewing person, extending from the centerline of the viewing person, falls within a distance of 10 cm from the centerline of the viewed person. This distance criterion can be adapted based on the estimation accuracy of the facing direction, in various embodiments.

Figure 3A:
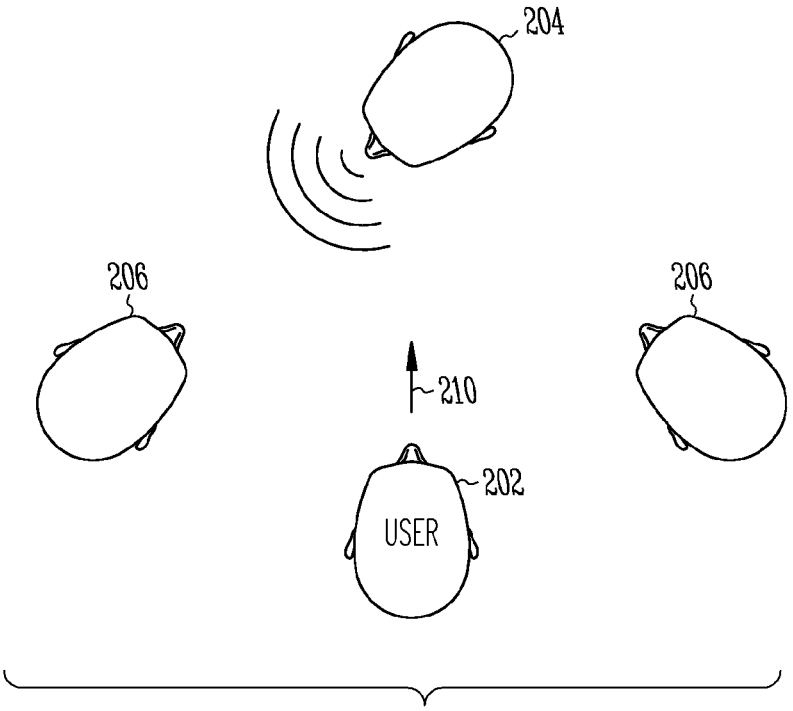
FIGS. 3A-3C illustrate a user of a hearing assistance device in a multi-talker setting, according to various embodiments of the present subject matter.
Figure 3B:
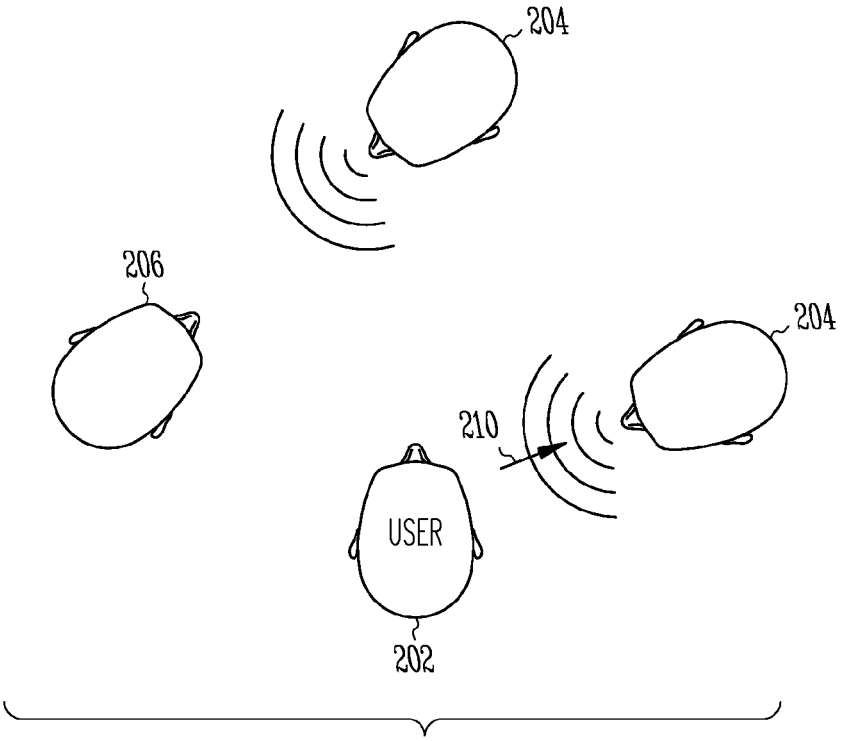
Figure 3C:
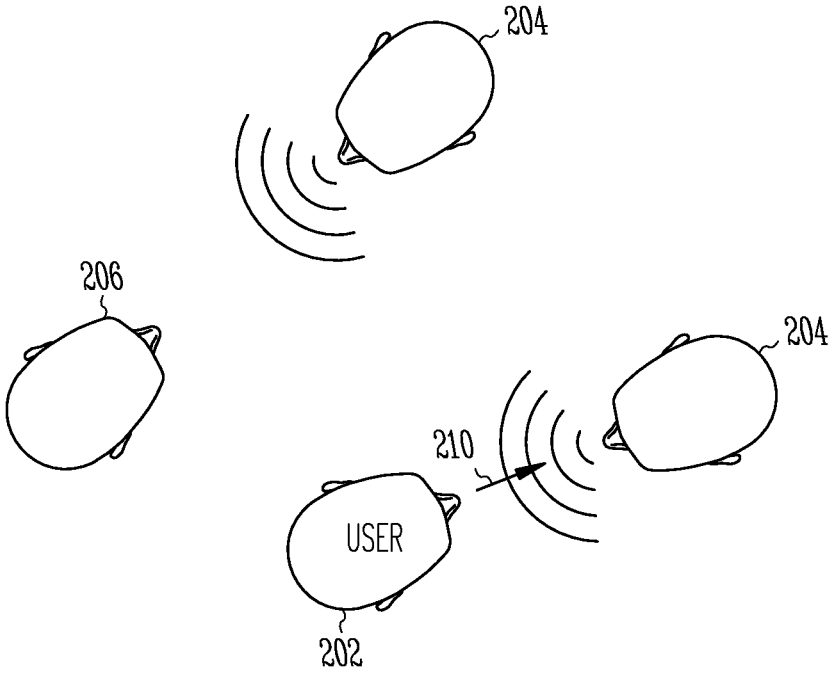
Figure 4:
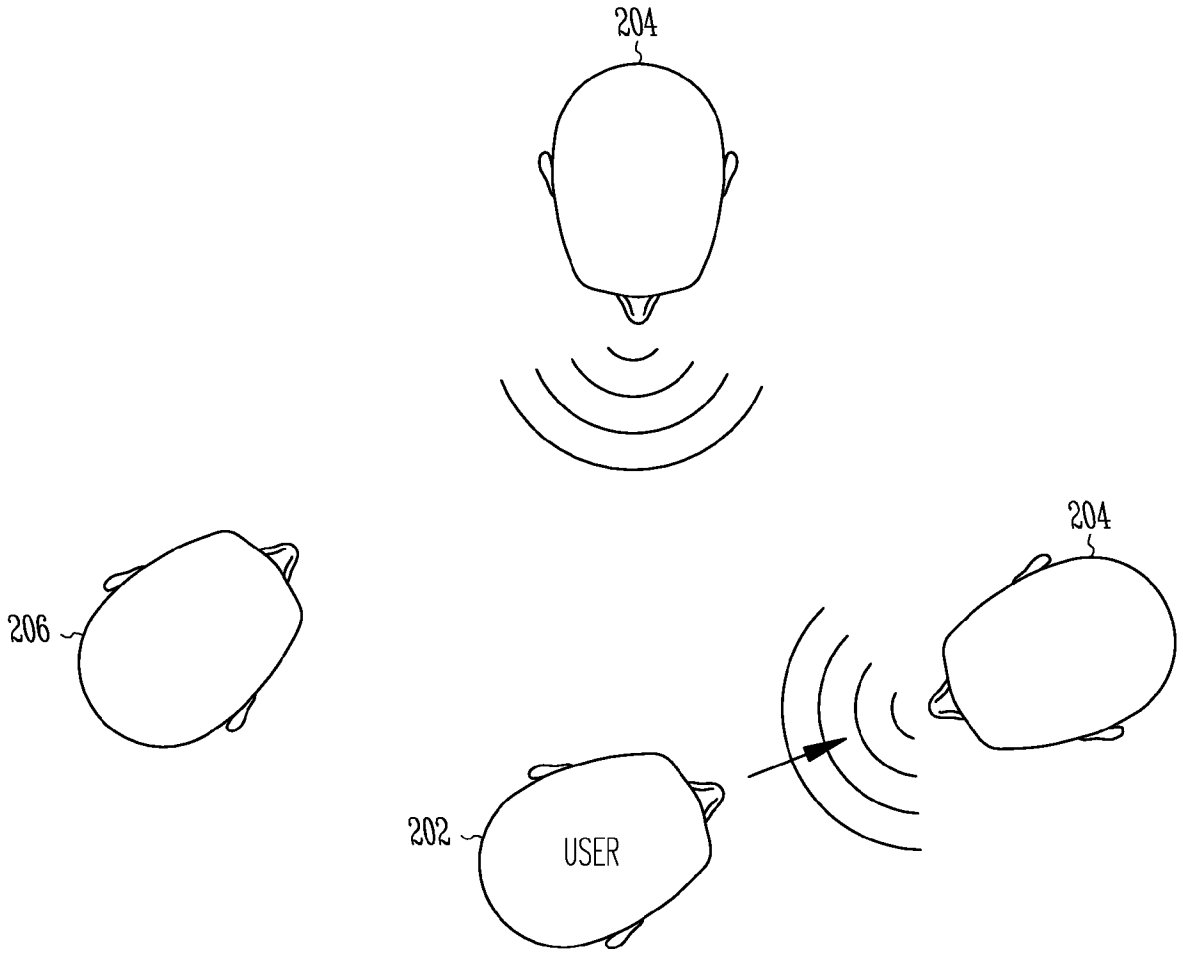
FIG. 4 illustrate a user of a hearing assistance device in a multi-talker setting, according to various embodiments of the present subject matter.

When a talker 204 in the user's cluster faces the user 202 and speaks, the marker 210 is pointed at this talker 204 independent of the user's facing direction, as shown in the embodiment of FIG. 3B. It can be expected that the user 202 will turn their head to this talker 204. Therefore, the marker 210 is updated in time to follow the change in target direction relative to the user's head, as shown in the embodiment of FIG. 3C. In one embodiment, when the marker is updated in time to follow the change in target direction relative to the user's head movement, the user and the talker can end up facing each other, and the user's line of sight eventually coincides with the talker's line of sight, as in the embodiment of FIG. 3A. Again, when the talker 204 stops speaking, the marker state is set to idle. When more than one talker 204 in the user's cluster face the user 202 and speak, the marker is set to the idle state, as shown in the embodiment of FIG. 4.

Next, the marker signal 210 is passed on to a sound processing unit 106. In alternate embodiments, the sound processing unit 106 executes the following processing: (1) When the marker signal changes its direction (with exception of continuous rotations because they are due to rotations of the user's head) or when it changes from the idle to the active state, the sound processing unit synthesizes a short notification signal, such as a tonal beep or a short burst of broadband noise, that is localized in the direction of the marker. This is achieved by convolution with the appropriate head-related-transfer-function. Thus, the user's attention is drawn to the target direction. Note that a notification signal as described above is not to be used in situations where user head turns are penalized such as driving an automobile; (2) When the marker signal is active, the sound processing unit 106 is an adaptive directional system that amplifies the target sound in the direction of the marker relative to the sounds from other directions; (3) When the marker signal is active, the sound processing unit 106 employs binary masking to enhance sounds in the direction of the marker and attenuate all other sounds.

The present subject matter aids communication in challenging environments in intelligent ways. It improves the communication experience for both users and talkers, for the latter by reducing the need to repeat themselves.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, infrared, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, SPI, PCM, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the user.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), completely-in-the-canal (CIC) or invisible-in-canal (IIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of operating a hearing assistance device for a user in an environment, the method comprising:

sensing parameters related to facing orientation of a talker of a plurality of talkers in communication with the user, location of the talker, and talking activity of the talker within the environment using a sensor providing parameters to a processor of the hearing assistance device;

synthesizing a directional marker signal based on the sensed parameters using the processor; and using the directional marker signal to control processing of the hearing assistance device using a sound processing unit of the hearing assistance device.

2. The method of claim 1, wherein using the directional marker signal to control processing includes steering an adaptive directional system.

3. The method of claim 1, wherein using the directional marker signal to control audio processing includes activating a binary masking noise reduction based on the direction marker signal.

4. The method of claim 1, wherein, if no talker is identified, synthesizing the directional marker includes synthesizing an idle marker.

5. The method of claim 1, wherein synthesizing a directional marker signal includes performing a cluster analysis.

6. The method of claim 1, wherein synthesizing a directional marker signal includes updating the directional marker signal in real time to follow a change in target direction relative to the user.

7. The method of claim 1, wherein when the directional marker signal changes, the sound processing unit synthesizes a notification signal that is localized in the direction of the marker signal, to draw the user's attention to a target direction.

8. The method of claim 7, wherein the notification signal includes one or more of a tonal beep or a short burst of broadband noise.

9. The method of claim 1, wherein sensing parameters related to facing orientation, location, and talking activity of a talker in communication with the user includes using a camera.

10. The method of claim 1, wherein sensing parameters related to facing orientation, location, and talking activity of a talker in communication with the user includes using an accelerometer.

11. A hearing assistance system including a hearing assistance device for a user in an environment, the system comprising:

a sensor configured to sense parameters related to facing orientation of a talker of a plurality of talkers in communication with the user, location of the talker, and talking activity of the talker within the environment;

a decision module configured to synthesize a directional marker signal based the location of the talker with respect to the user using the sensed parameters; and a sound processing unit configured to use the directional marker signal to control sound processing of the hearing assistance device.

12. The system of claim 11, wherein the sound processing unit is configured to steer an adaptive directional system using the directional marker signal.

13. The system of claim 11, wherein the sound processing unit is configured to activate a binary masking noise reduction based on the direction marker signal.

14. The system of claim 11, wherein the hearing assistance device includes a hearing aid.

15. The system of claim 14, wherein the hearing aid includes an in-the-ear (ITE) hearing aid.

16. The system of claim 14, wherein the hearing aid includes a behind-the-ear (BTE) hearing aid.

17. The system of claim 14, wherein the hearing aid includes an in-the-canal (ITC) hearing aid.

18. The system of claim 14, wherein the hearing aid includes a receiver-in-canal (RIC) hearing aid.

19. The system of claim 14, wherein the hearing aid includes a completely-in-the-canal (CIC) hearing aid.

20. The system of claim 14, wherein the hearing aid includes a receiver-in-the-ear (RITE) hearing aid.

21. The system of claim 14, wherein the hearing aid includes an invisible-in-canal (IIC) hearing aid.

* * * * *